United States Patent [19]

Oord

[11] Patent Number: 4,688,329

[45] Date of Patent: Aug. 25, 1987

[54] SHAVING APPARATUS

[75] Inventor: Klaas T. Oord, Drachten, Netherlands

[73] Assignee: U.S. Philips Corporation, New York, N.Y.

[21] Appl. No.: 774,417

[22] Filed: Sep. 10, 1985

[30] Foreign Application Priority Data

Sep. 12, 1984 [NL] Netherlands ..... 8402778

[51] Int. Cl.[4] ..... B26B 19/14

[52] U.S. Cl. ..... 30/43.6; 30/89

[58] Field of Search ..... 30/43.1, 43.6, 88, 89, 30/87

[56] References Cited

U.S. PATENT DOCUMENTS

| | | | |
|---|---|---|---|
| 2,280,052 | 4/1942 | Bahr | 30/43.6 |
| 3,797,109 | 3/1974 | Yamada et al. | 30/43.1 |
| 4,343,086 | 8/1982 | de Vries et al. | 30/43.6 |

*Primary Examiner*—Douglas D. Watts

*Attorney, Agent, or Firm*—Thomas A. Briody; William J. Streeter; Rolf E. Schneider

[57] ABSTRACT

A shaving apparatus comprises a housing and a shaving head rotatably mounted on the housing and having at least two rotary shaving units each comprising an external shaving member provided with hair-entry apertures and an internal shaving member rotatably drivable relative to the external shaving member, the axes of the rotatably drivable internal shaving members being parallel to each other. The shaving head is mounted such that it is rotatable relative to the housing about a rotational axis inclined relative to the longitudinal dimension of the housing and parallel to the axes of the rotatably drivable internal shaving members. Thereby the shaving head can be rotated about the rotational axis to various positions oriented differently relative to the housing.

2 Claims, 16 Drawing Figures

SHAVING APPARATUS

This invention relates to a shaving apparatus comprising a housing which is at least partly formed as a grip, and a shaving head which is connected to or mounted on the housing and which has at least two rotary shaving units each comprising an external shaving member provided with hair-entry apertures and an internal shaving member rotatably drivable relative to such external shaving member.

Such a shaving apparatus is known, for example, from British Pat. No. 1,471,338.

In this known apparatus the shaving head is rigidly connected to the housing, so that the position of the shaving units relative to the housing is fixed. During shaving the shaving apparatus is moved over the skin with the two shaving units situated either side-by-side or in line with one another relative to the direction of movement, depending on the personal preference of the user of the shaving apparatus or on the part of the skin being shaved. Sometimes the apparatus consequently has to be held in an inconvenient position which is tiring for the arm.

It is the object of the present invention to solve these problems and to this end the invention is characterized in that the shaving head is connected to or mounted on the housing in such a way as to be rotatable between positions in which the shaving units occupy different positions relative to the housing.

The invention will now be described in more detail with reference to the accompanying drawings, in which.

Figure 5:
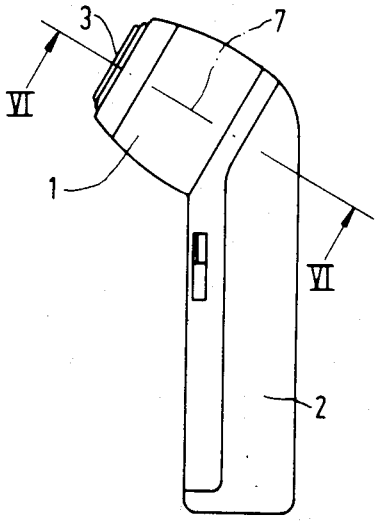
FIG. 5 is a side view of the shaving apparatus shown in FIG. 1.
Figure 6:
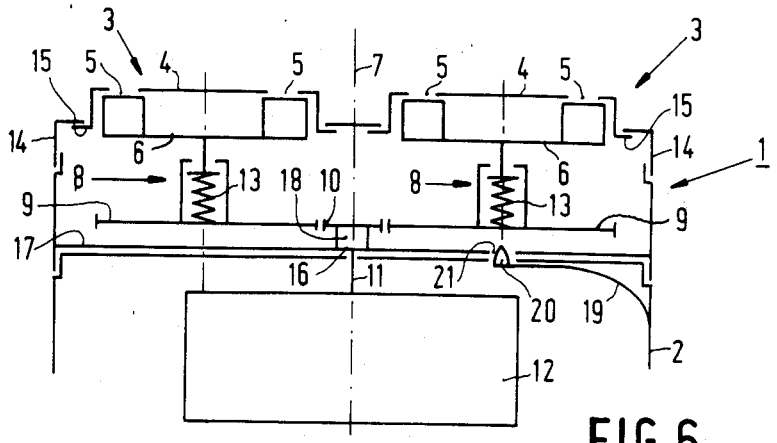
FIG. 6 is a schematic cross-sectional view on an enlarged scale taken on the line VI—VI in FIG. 5.

The shaving apparatus shown in FIGS. 1 to 6 comprises a shaving head 1 and a housing 2 which also serves as a grip. The shaving head 1 includes two rotary shaving units 3, which each comprise an external shaving member 4 with hair-entry apertures 5 and a rotatable internal shaving member 6 (FIG. 6).

Figure 1:
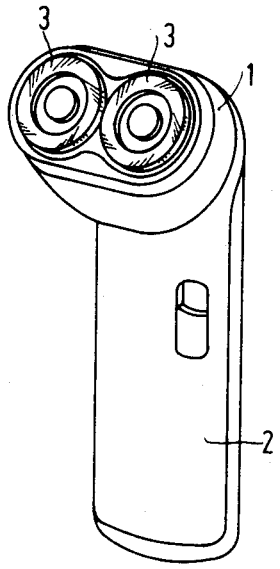
FIG. 1 is a perpsective view of a shaving apparatus comprising two shaving units.
Figure 2:
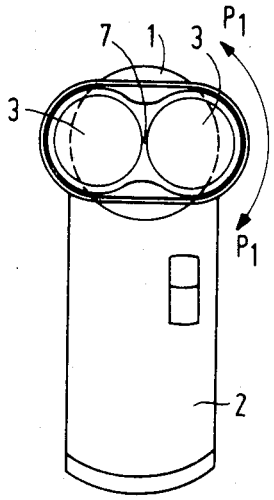
FIGS. 2, 3 and 4 are front views of the shaving apparatus of FIG. 1, showing the shaving head in different positions relative to the housing.
Figure 3:
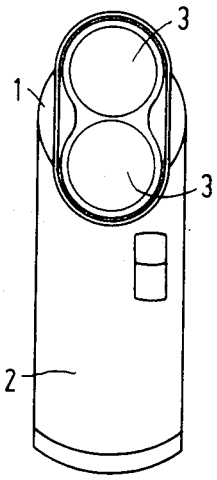
Figure 4:
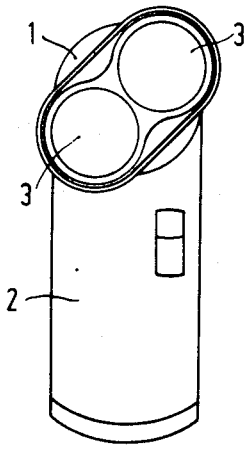

The shaving head 1 is rotatable relative to the housing 2 about an axis 7, as is indicated by arrows $P_1$ (FIG. 2). As shown in FIG. 5, rotational axis 7 is inclined relative to the longitudinal dimension of the housing 2. Thus, the shaving head is rotatable between positions in which the shaving units are oriented differently relative to the housing, for example the positions shown in FIGS. 2, 3 and 4. The position shown in FIG. 2 is suitable, for example, for shaving the relatively large areas of the face and the position shown in FIG. 3 may be used for shaving nasal hairs and hairs in areas which are difficult to reach, such as in and around the ears. The position shown in FIG. 4 may be advantageous for lefthanded persons.

FIG. 6 shows schematically how the internal shaving members are rotatably driven. The internal shaving members 6 are coupled to gear wheels 9 by means of parallel hollow spindles 8. The gear wheels 9 mesh with a pinion 10 fixed on the shaft 11 of an electric motor 12 secured inside the housing 2. The spindles 8 contain springs 13 so that the shaving units 3 are depressible relative to the shaving head 1 against spring force. The shaving head had a removable cap 14 which engages over flanges 15 on the respective external shaving members.

The shaft 11 of the electric motor 12 projects through a central opening 16 in a bottom plate 17 of the shaving head 1. The hub 18 of the pinion 10 is supported by the bottom plate. In this way the shaving head 1 is rotatable relative to the housing 2 about the shaft 11, but the shaving head can be removed from the housing only after removal of the pinion 10.

In the present embodiment the axis of the shaft 11 coincides with the inclined rotational axis 7, which extends substantially parallel to the axes or spindles 8 of the rotatable internal shaving members 6.

A latching projection 20 supported by a resilient arm 19 engages in an opening 21 in the bottom plate 17, a number of which openings is provided, each corresponding to a specific rotational position of the shaving head. In this way the shaving head 1 is latched in a selected position relative to the housing 2.

Figure 7:
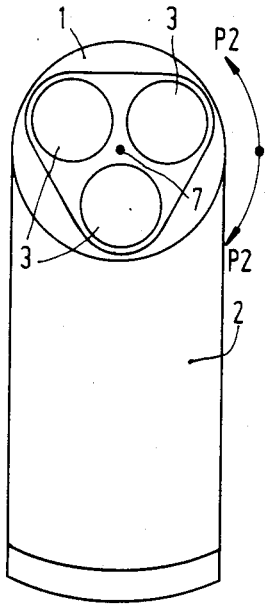
FIGS. 7 and 8 are front views of a modification of the shaving apparatus shown in FIG. 1.
Figure 9:
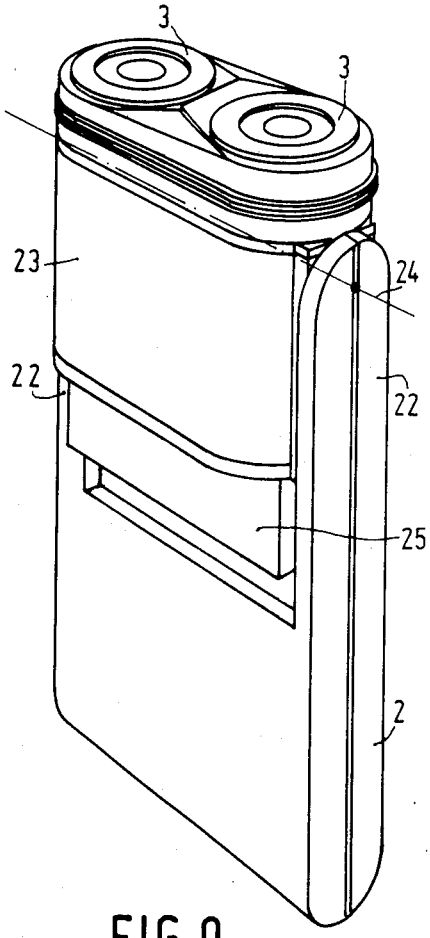
FIG. 9 is a perspective view on an enlarged scale of a shaving apparatus in accordance with another embodiment of the invention.
Figure 8:
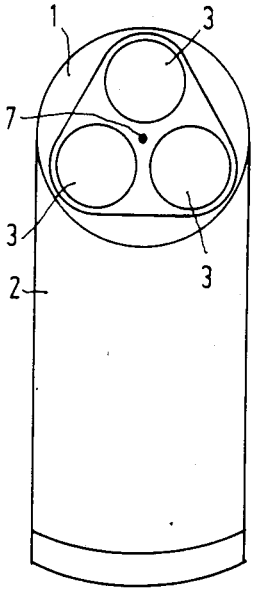
Figure 10:
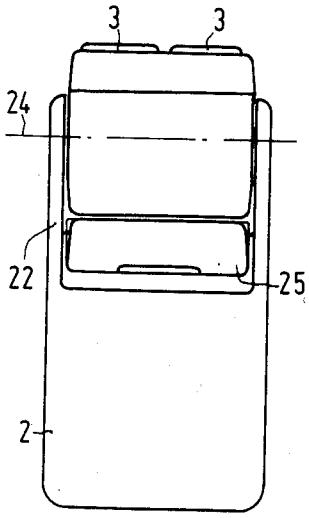
FIG. 10 is a front view of the shaving apparatus shown in FIG. 9.

In the embodiment shown in FIGS. 7 and 8 the shaving head is rotatably connected to the housing in the same way as in the embodiment shown in FIGS. 1 to 6, see the arrows P2 (FIG. 7). However, the head now has three instead of two shaving units. The rotational position selected for the shaving head will depend on the personal preference of the user. It is obvious that rotational positions other than those shown are possible with the above embodiments.

Figure 11:
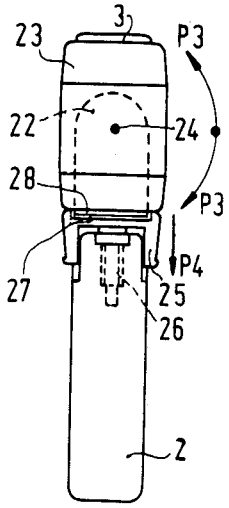
FIGS. 11 and 12 are side views of the shaving apparatus of FIGS. 9 and 10, showing the shaving head in different positions relative to the housing.

In the embodiment shown in FIGS. 9 to 12 the housing 2 includes two projecting arms 22 between which a shaving head 23 is pivotally supported. This shaving head 23 has two shaving units 3 and also includes the drive motor for driving the internal shaving members of the shaving units 3, driving being effected, for example, in a manner similar to that shown in FIG. 6. The housing 2 accommodates the batteries for powering the electric motor. The shaving head 23 is pivotal about an axis 24, as indicated by the arrows P3 (FIG. 11). The housing 2 includes a wall portion 25 which is situated between the arms 22 and which is movable relative to the remainder of the housing 2 in the direction indicated by the arrow P4 against the force of a spring 26 (see FIG. 11, in which one of the arms 22 is omitted for the sake of clarity). The movable wall portion 25 has a recess 27 in which a projecting portion 28 on the underside of the shaving head 23 engages. In this way the shaving head is locked against undesired rotation about the axis 24. The shaving head 23 can be disengaged from the wall portion 25 to permit rotation of the shaving head by manually depressing the movable wall portion 25 in the direction indicated by the arrow P4. The shaving head 23 can be pivoted through 180° from the position shown in FIG. 11 so that the shaving units 3 are situated between the arms 22 and face the wall portion 25. If the wall portion is now released, it is urged upwards to cover the shaving units. The shaving units are now situated in the recess 27, so that they are well protected by the wall portion 25, and it is therefore not necessary to provide a separate case for the storage of the apparatus.

Figure 12:
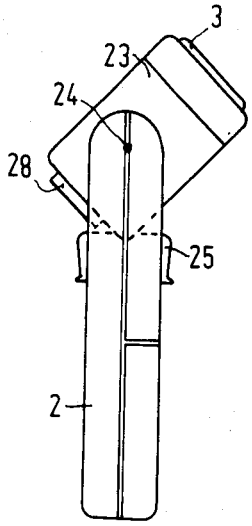

FIG. 12 shows the shaving head 23 in an inclined position relative to the housing 2. In this position the shaving head is also locked against undesired rotation by means of the wall portion 25.

Figure 13:
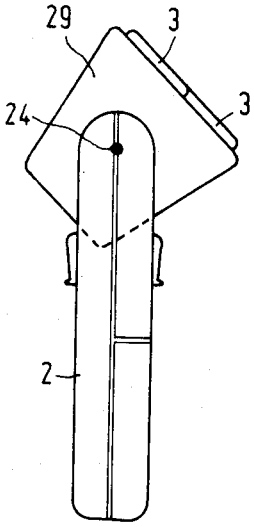
FIGS. 13 and 14 are side views of a modification of the embodiment shown in FIGS. 9 and 10.
Figure 15:
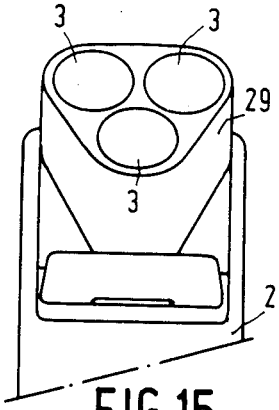
FIGS. 15 and 16 are front views corresponding to the side views of FIGS. 13 and 14, respectively.
Figure 14:
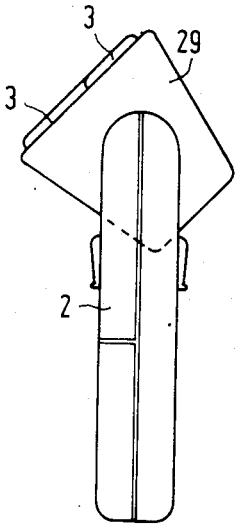
Figure 16:
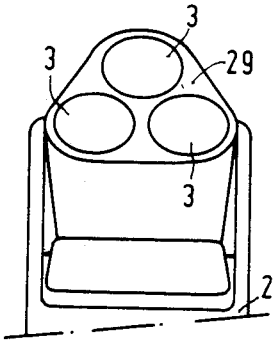

The embodiment shown in FIGS. 13 to 16 is a modification of that shown in FIGS. 9 to 12 and has a shaving head 29 which comprises three shaving units 3 instead of two, the three shaving heads being arranged in a triangular pattern. FIGS. 13 and 15 show the shaving head inclined relative to the housing in a direction such that a vertex of the triangle points downwardly when the apparatus is in an upright position (as in the drawings). In FIGS. 14 and 16, the shaving head is shown indicated in the opposite direction so that the same vertex of the triangle points upwardly when the apparatus is in an upright position. Thus, the user of the apparatus can again select different positions of the shaving units relative to the housing.

What is claimed is:

1. A shaving apparatus comprising a housing; and a shaving head rotatably mounted on said housing and having at least two rotary shaving units each comprising an external shaving member provided with hair-entry apertures and an internal shaving member rotatably drivable relative to said external shaving member, the axes of the rotatably drivable internal shaving members being parallel to each other; the mounting of the shaving head being such that the shaving head is rotatable relative to the housing about a rotational axis inclined relative to the longitudinal dimension of the housing and parallel to the axes of the rotatably drivable internal shaving members, whereby the shaving head can be rotated about the rotational axis to various positions oriented differently relative to the housing.

2. A shaving apparatus according to claim 1, which includes means to latch the shaving head in any of said various positions.

* * * * *